US007597073B2

(12) United States Patent
Asahi

(10) Patent No.: US 7,597,073 B2
(45) Date of Patent: Oct. 6, 2009

(54) VALVE TIMING CONTROL APPARATUS

(75) Inventor: Takeo Asahi, Toyota (JP)

(73) Assignee: Aisin Seiki Kabushiki Kaisha, Kariya-Shi, Aichi-Ken (JP)

( * ) Notice: Subject to any disclaimer, the term of this patent is extended or adjusted under 35 U.S.C. 154(b) by 127 days.

(21) Appl. No.: 11/882,106

(22) Filed: Jul. 30, 2007

(65) Prior Publication Data

US 2008/0053386 A1 Mar. 6, 2008

(30) Foreign Application Priority Data

Aug. 30, 2006 (JP) ..... 2006-234124

(51) Int. Cl.
*F01L 1/34* (2006.01)

(52) U.S. Cl. ..... 123/90.15; 123/90.17; 464/160

(58) Field of Classification Search ..... 123/90.15, 123/90.16, 90.17, 90.18; 464/1, 2, 160
See application file for complete search history.

(56) References Cited

FOREIGN PATENT DOCUMENTS

JP 09317410 A * 12/1997

JP 11-294121 A 10/1999

* cited by examiner

*Primary Examiner*—Ching Chang
(74) *Attorney, Agent, or Firm*—Buchanan Ingersoll & Rooney PC

(57) ABSTRACT

A valve timing control apparatus includes a driving side rotational member synchronously rotatable with a crankshaft of an internal combustion engine, a driven side rotational member arranged coaxially with the driving side rotational member and synchronously rotatable with a camshaft of the internal combustion engine, a plurality of fluid pressure chambers each including an advanced angle chamber and a retarded angle chamber, a plurality of vanes each dividing the fluid pressure chamber into the advanced angle chamber and the retarded angle chamber, an intermediate member of which a portion is provided in the fluid pressure chamber and engageable with the driving side rotational member and the driven side rotational member, and an engagement member for causing the intermediate member to engage with either one of the driving side rotational member and the driven side rotational member in response to an operating state of the internal combustion engine.

15 Claims, 14 Drawing Sheets

VALVE TIMING CONTROL APPARATUS

CROSS REFERENCE TO RELATED APPLICATIONS

This application is based on and claims priority under 35 U.S.C. § 119 to Japanese Patent Application No. 2006-234124, filed on Aug. 30, 2006, the entire content of which is incorporated herein by reference.

FIELD OF THE INVENTION

This invention generally relates to a valve timing control apparatus. More particularly, the invention pertains to a valve timing control apparatus for controlling an opening and closing timing of at least one of an intake valve and an exhaust valve of an internal combustion engine based on an operating state of the engine.

BACKGROUND

A known vane type valve timing control apparatus is disclosed in JP11-294121A. The valve timing control apparatus disclosed controls an opening and closing timing of valves of an internal combustion engine by a supply and a discharge of an operational fluid relative to a fluid chamber formed between a housing member and a vane rotor. The housing member is one of rotational members integrally rotating with a pulley or a sprocket, which synchronously rotates with a crankshaft of the internal combustion engine. The vane rotor is the other one of rotational members including a vane used for dividing the fluid chamber into two operational chambers and rotating on a radially inner side of the housing member. The vane rotor is provided so as to be coaxial and rotatable with the housing member, and integrally rotating with a camshaft of the internal combustion engine for opening and closing the valves of the internal combustion engine. The two operational chambers are equal to an advanced angle chamber displacing a relative rotational phase of the vane rotor to the housing in an advanced angle direction by a supply of an operational fluid to the advanced angle chamber, and a retarded angle chamber displacing a relative rotational phase of the vane rotor to the housing in a retarded angle direction by the supply of the operational fluid to the retarded angle chamber. The advanced angle chamber and the retarded angle chamber are separated from each other by means of the vane. Then, a fluid pressure in the advanced angle chamber and the retarded angle chamber is adjusted to thereby control the relative rotational phase between the housing member and the vane rotor. That is, in response to an operation state of the engine, a rotation of the camshaft relative to the crankshaft is controlled to thereby control an opening and closing timing of the valves. The controlling performance depends on a pressure receiving area and a volume of the fluid pressure chamber, and the like.

For example, the intake valve is controlled on a most retarded angle side at a start of the internal combustion engine, an idling driving state, and the like, and then controlled towards the advanced angle side in response to an increase of revolutions of the internal combustion engine. The operational fluid (for example, oil) is activated by a power of the internal combustion engine and is supplied by an oil pump having a suction capacity in response to the revolutions of the internal combustion engine. In the case of low revolutions of the internal combustion engine, the fluid pressure decreases and thus a sufficient pressure receiving area and the volume of the fluid pressure chamber are provided for ensuring necessary responsiveness.

On the other hand, when the internal combustion engine turns to a stable operation state, the intake valve should be appropriately controlled between the advanced angle side and the retarded angle side in response to the operation state of the engine. However, since the oil is used as lubricant of the internal combustion engine or a power transmission mechanism, the increase of temperature may cause decrease of viscosity of the oil. As a result, leakage may easily occur to thereby induce a decrease of a hydraulic pressure. Further, because of a pressure control valve normally provided at the hydraulic pressure system, all of the suction force of the oil pump increasing in response to the revolutions of the internal combustion engine may not be used. Accordingly, required operational responsiveness may not be obtained. In order to increase the responsiveness, it is effective to reduce the volume of the fluid pressure chamber. However, a torque generation may also be reduced to thereby deteriorate the control ability especially at low revolutions.

Thus, a need exists for a valve timing control apparatus which is not susceptible to the drawback mentioned above.

SUMMARY OF THE INVENTION

According to an aspect of the present invention, a valve timing control apparatus includes a driving side rotational member synchronously rotatable with a crankshaft of an internal combustion engine, a driven side rotational member arranged coaxially with the driving side rotational member and synchronously rotatable with a camshaft that controls an opening and closing timing of valves of the internal combustion engine, a plurality of fluid pressure chambers formed between the driving side rotational member and the driven side rotational member and each including an advanced angle chamber and a retarded angle chamber, the advanced angle chamber displacing a relative rotational phase of the driven side rotational member to the driving side rotational member in an advanced angle direction by a supply of a fluid to the advanced angle chamber, the retarded angle chamber displacing the relative rotational phase of the driven side rotational member to the driving side rotational member in a retarded angle direction by the supply of the fluid to the retarded angle chamber, a plurality of vanes provided at either one of the driving side rotational member and the driven side rotational member and each dividing the fluid pressure chamber into the advanced angle chamber and the retarded angle chamber, an intermediate member of which a portion is provided in the fluid pressure chamber and engageable with the driving side rotational member and the driven side rotational member, and an engagement member for causing the intermediate member to engage with either one of the driving side rotational member and the driven side rotational member in response to an operating state of the internal combustion engine.

BRIEF DESCRIPTION OF THE DRAWINGS

The foregoing and additional features and characteristics of the present invention will become more apparent from the following detailed description considered with reference to the accompanying drawings, wherein.

DETAILED DESCRIPTION

Embodiments of the present invention will be explained with reference to the attached drawings.

Figure 1:
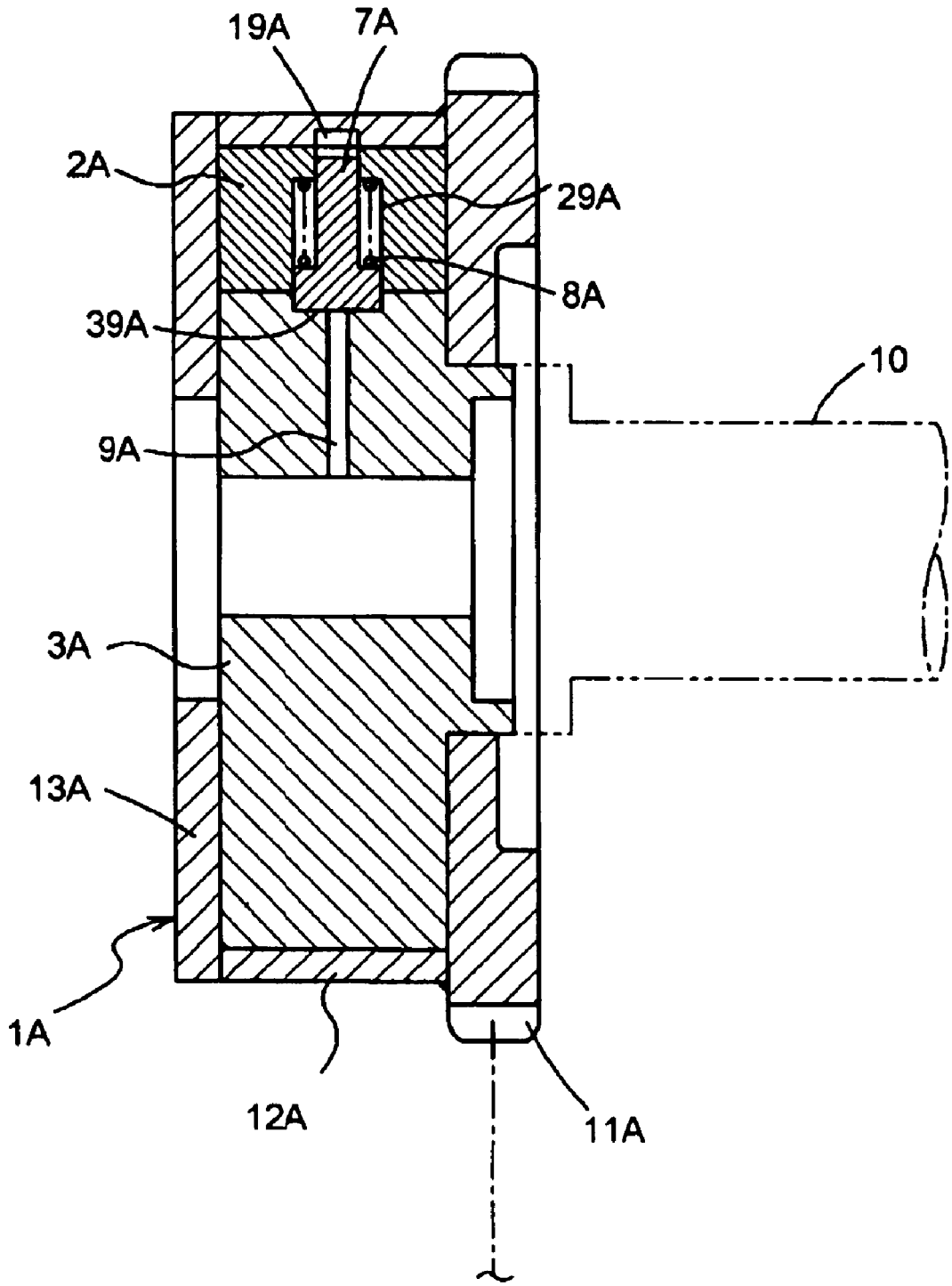
FIG. 1 is a cross-sectional view with reference to a rotational axis of a valve timing control apparatus according to a first embodiment of the present invention.
Figure 2:
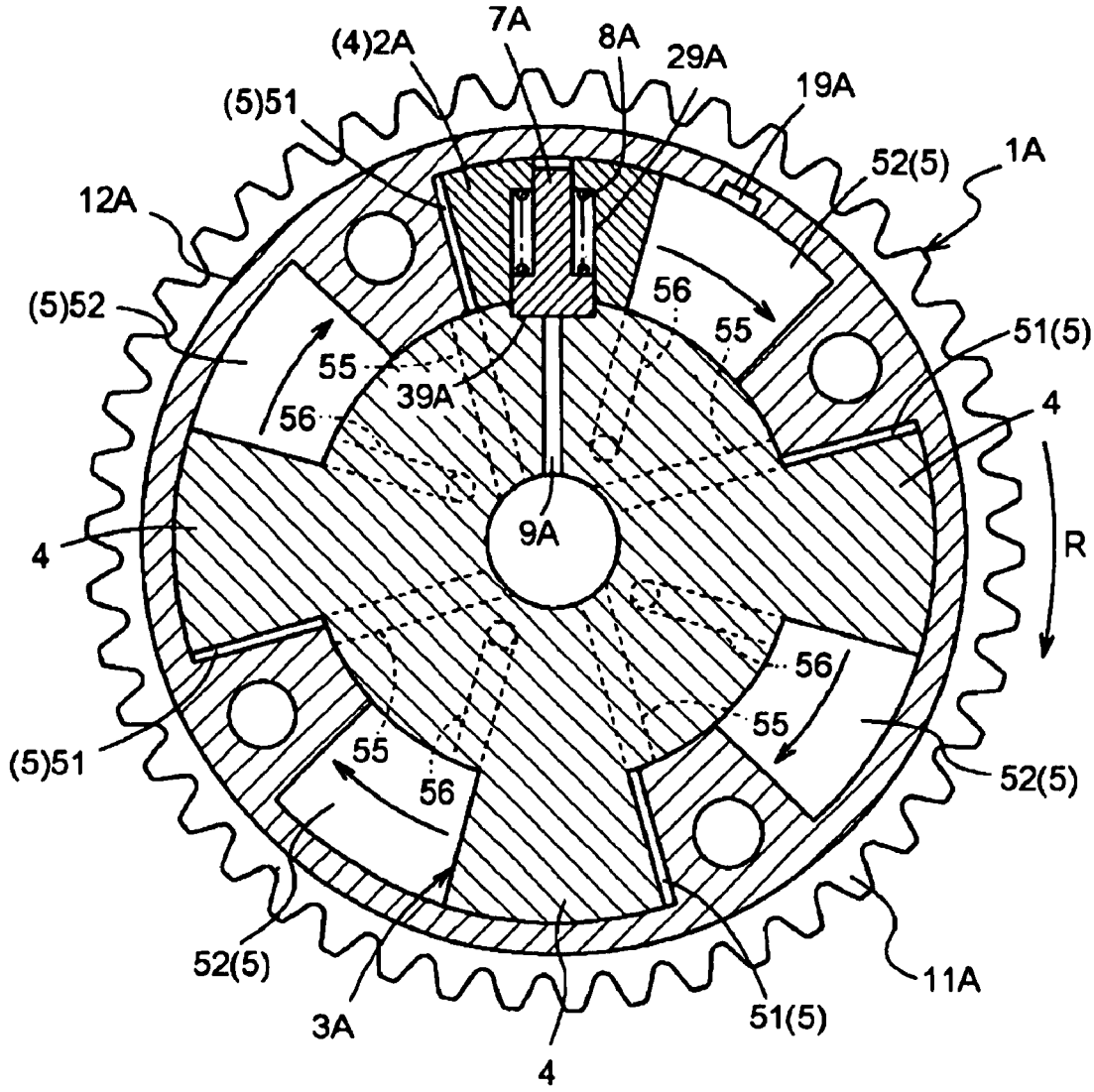
FIG. 2 is a perpendicular cross-sectional view of FIG. 1 for illustrating an initial state (i.e., state before an engagement switch operation) of a driving side rotational member, a driven side rotational member, and an intermediate member.
Figure 15:
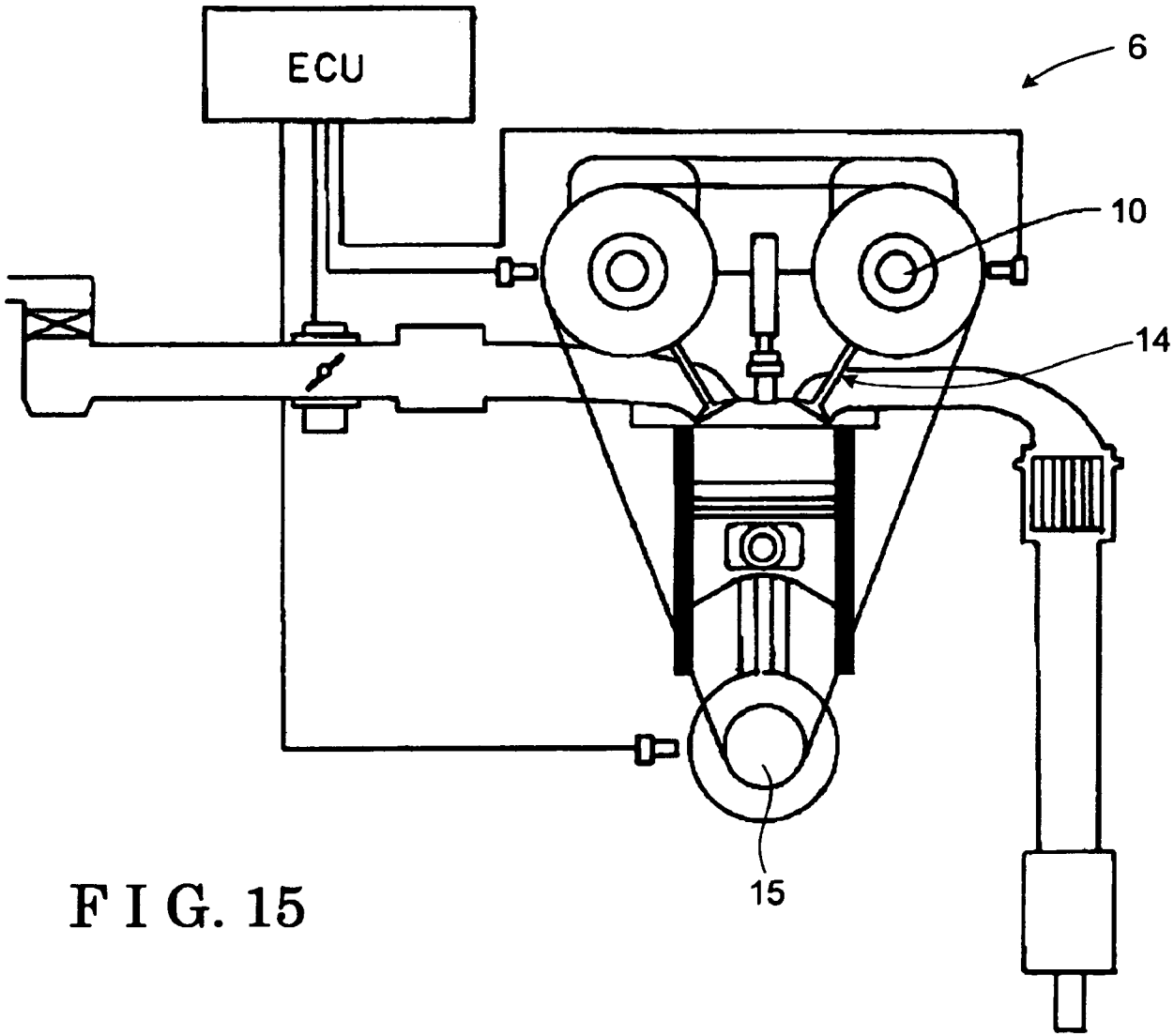
FIG. 15 is a view illustrating a structure of the valve timing control apparatus according to the first and second embodiments of the present invention.

A first embodiment will be explained below. FIG. 1 is a cross-sectional view in a rotational axis direction of a valve timing control apparatus for controlling an opening and closing timing of at least one of an intake valve and an exhaust valve of an engine (i.e., internal combustion engine) based on an operation state of the engine. FIG. 2 is a perpendicular cross-sectional view of FIG. 1. FIG. 15 is a view illustrating a structure of the valve timing control apparatus. As illustrated in FIGS. 1, 2, and 15, the vane-type valve timing control apparatus according to the first embodiment includes a driving side rotational member 1A, a driven side rotational member 3A, fluid pressure chambers 5, and vanes 4. Each vane 4 is provided as a member including a portion for dividing the fluid pressure chamber 5. Thus, the present embodiment is not limited by a difference in structure of the vane 4 such as a block shape and a plate shape, nor whether the vane 4 is integrally formed or separately formed with the rotational member.

The driving side rotational member 1A is synchronously rotatable in an R direction in FIG. 2 with a crankshaft 15 of an engine 6. The driven side rotational member 3A is provided so as to be coaxial and relatively rotatable with the driving side rotational member 1A. In addition, the driven side rotational member 3A rotates in the R direction as a unit with a camshaft 10 for opening and closing valves 14 of the engine 6. According to the present embodiment, as illustrated in FIGS. 1 and 2, the driving side rotational member 1A is an outer rotor attached to a radially outer side of an inner rotor, which is the driven side rotational member 3A. The outer rotor 1A includes a sprocket (or a pulley) 11A, a housing 12A, and a plate 13A. A driving force of the engine 6 is transmitted to the sprocket 11A via a timing chain or a timing belt.

Multiple fluid pressure chambers 5 are formed between the outer rotor 1A and the inner rotor 3A. Each fluid pressure chamber 5 is divided into an advanced angle chamber 51 and a retarded angle chamber 52 by means of the vane 4. When an operational fluid such as oil is supplied to the advanced angle chamber 51, a relative rotational phase of the inner rotor 3A to the outer rotor 1A is shifted in a direction where the phase is advanced. On the other hand, when the oil is supplied to the retarded angle chamber 52, the relative rotational phase of the inner rotor 3A to the outer rotor 1A is shifted in a direction where the phase is retarded. That is, because of a supply and a discharge of the operational fluid relative to the fluid pressure chambers 5, the aforementioned relative rotational phase is adjusted. FIG. 2 illustrates a state where the relative rotational phase of the inner rotor 3A to the outer rotor 1A is positioned on a most retarded angle side. For example, when the oil is supplied to the advanced angle chambers 51 via respective advanced angle oil passages 55 from the state in FIG. 2, the inner rotor 3A rotates relative to the outer rotor 1A in an arrow direction illustrated in the fluid pressure chamber 5 in FIG. 2. That is, the inner rotor 3A is shifted in the advanced angle direction. At this time, the possible oil in the retarded angle chambers 52 is discharged therefrom via respective retarded angle oil passages 56. The vanes 4 can be provided at either the outer rotor 1A or the inner rotor 3A. According to the present embodiment, the vanes 4 are provided at the inner rotor 3A.

An intermediate member 2A illustrated in FIGS. 1 and 2 is engageable with the outer rotor 1A and the inner rotor 3A. At least a portion of the intermediate member 2A is arranged within the fluid pressure chamber 5. According to the present embodiment, one of the multiple vanes 4 for the respective fluid pressure chambers 5 is constituted by the intermediate member 2A. The intermediate member 2A engages with one of the outer rotor 1A and the inner rotor 3A via a pin 7A (engagement member) in response to the operation state of the engine 6.

The pin 7A is biased by a spring 8A (biasing means) in a direction in which the intermediate member 2A and the inner rotor 3A serving as the rotational member where the vanes 4 are provided engage with each other. The intermediate member 2A engages with the inner rotor 3A as in an initial state (such as a state illustrated in FIG. 2). At this time, the intermediate member 2A functions as the vane 4. Then, an engagement switching means 9A displaces a position of the pin 7A against the biasing force of the spring 8A. The engagement switching means 9A releases the engagement between the inner rotor 3A and the intermediate member 2A while bringing the outer rotor 1A, where the vanes 4 are not provided, to engage with the intermediate member 2A. At this time, the intermediate member 2A functions as a wall surface of the outer rotor 1A. That is, a volume, an oil pressure receiving area, and the like of the fluid pressure chamber 5 vary depending on whether the intermediate member 2A engages with the outer rotor 1A or the inner rotor 3A. An operation performed by the engagement switching means 9A for displacing a position of the pin 7A so that the intermediate member 2A can engage with either the outer rotor 1A or the inner rotor 3A will be hereinafter referred to as an engagement switch operation.

The engagement switching means 9A displaces the position of the pin 7A by means of an oil pressure (hydraulic pressure of the fluid) or a centrifugal force generated in relation to the rotation of the outer rotor 1A or the inner rotor 3A. According to the present embodiment, an engagement switch oil passage is provided as the engagement switching means 9A apart from the advanced angle oil passages 55 or the retarded angle oil passages 56.

An operation of the valve timing control apparatus according to the present embodiment will be explained with reference to FIGS. 3 to 5 in addition to FIGS. 1 and 2. FIGS. 3A, 4A, and 5A are perpendicular cross-sectional views with respect to a rotational axis of the outer rotor 1A and the inner rotor 3A. FIGS. 3B, 4B, and 5B are enlarged views of an engagement portion between the pin 7A and the inner rotor 3A or the outer rotor 1A. As explained in the above, FIG. 2 is a perpendicular cross-sectional view of FIG. 1 for explaining the initial state (i.e., state before the engagement switch operation) of the outer rotor 1A, the inner rotor 3A, and the intermediate member 2A. In FIG. 2, the relative rotational phase of the inner rotor 3A to the outer rotor 1A is positioned on the most retarded angle side and is shifted towards the advanced angle side in a manner as mentioned above.

Figure 3A:
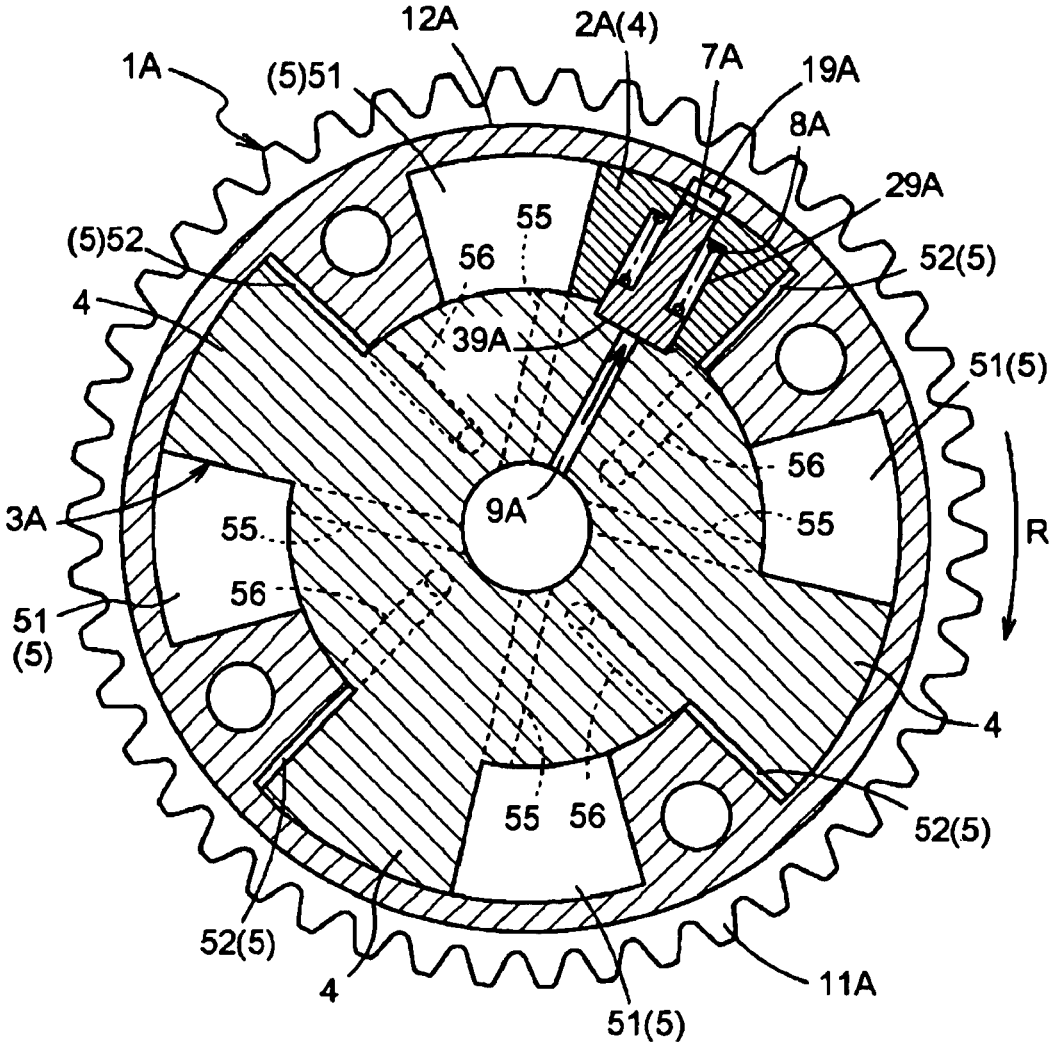
FIG. 3A is a perpendicular cross-sectional view with reference to the rotational axis of the valve timing control apparatus for illustrating a state immediately before the engagement switch operation.
Figure 3B:
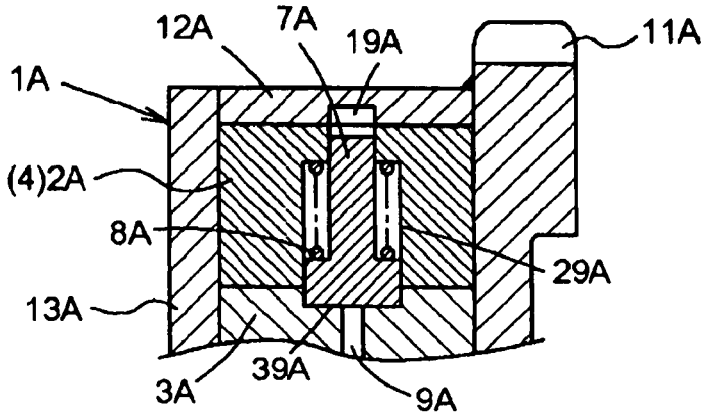
FIG. 3B is an enlarged view of an engagement portion between an engagement member and the driven side rotational member.
Figure 4A:
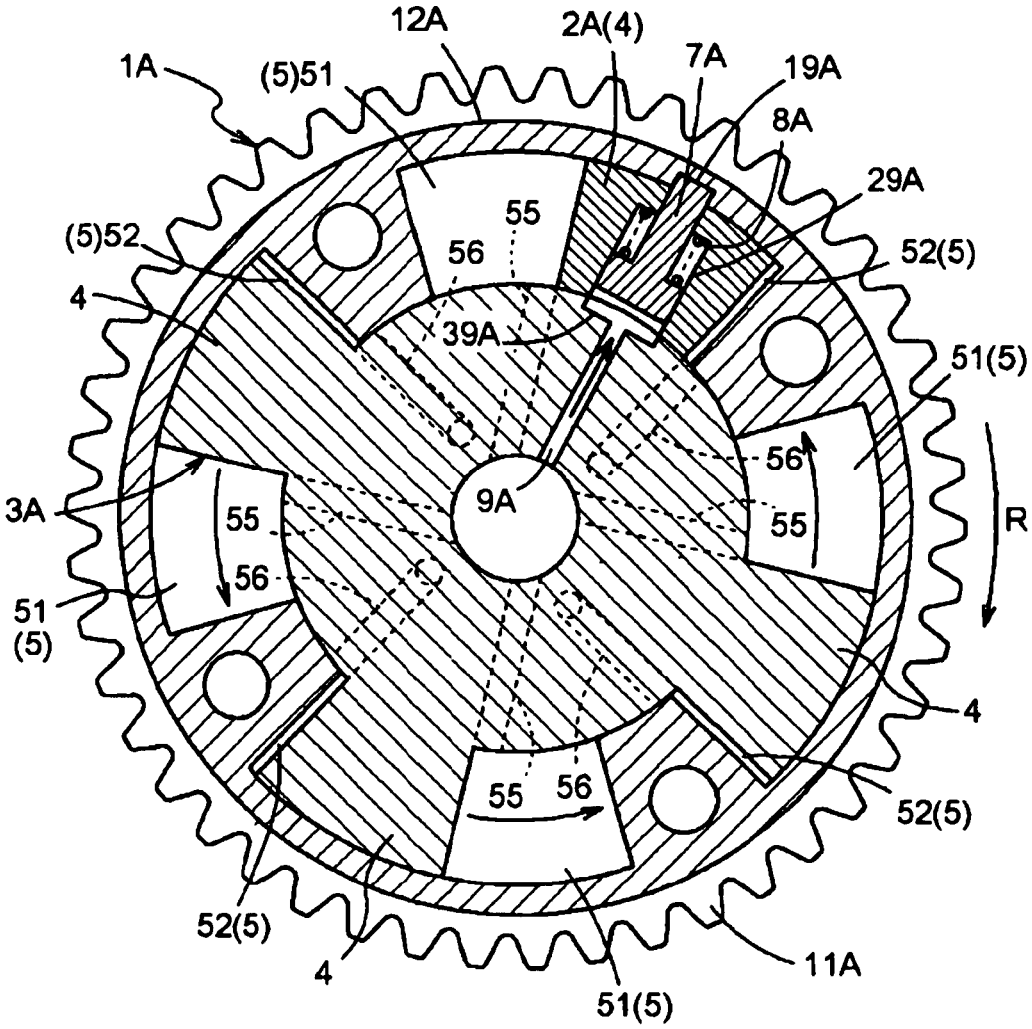
FIG. 4A is a perpendicular cross-sectional view with reference to the rotational axis of the valve timing control apparatus for illustrating a state immediately after the engagement switch operation.
Figure 4B:
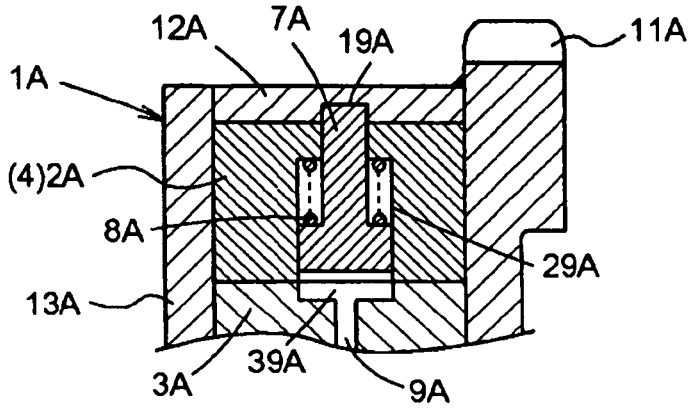
FIG. 4B is an enlarged view of the engagement portion between the engagement member and the driving side rotational member.

FIGS. 3A and 3B each illustrate a state immediately before the engagement switch operation. FIGS. 4A and 4B each illustrate a state immediately after the engagement switch operation. FIGS. 3A, 3B, 4A, and 4B each illustrate the relative rotational phase positioned on the most advanced angle side. However, the engagement switch operation is not necessarily performed at the most advanced angle phase and can be performed at an intermediate phase. More specifically, FIG. 3A illustrates a relative rotational phase of the inner rotor 3A to the outer rotor 1A (which will be hereinafter referred to as a "relative rotational phase of the both rotors") at which the engagement switch operation can be performed. The pin 7A is biased by the spring 8A within a pin hole 29A of the intermediate member 2A so as to be inserted into a pin hole 39A of the inner rotor 3A. Thus, the intermediate member 2A and the inner rotor 3A engage with each other. At this relative rotational phase, the pin hole 29A of the intermediate member 2A and a pin hole 19A of the outer rotor 1A are in communication with each other. When the oil is supplied to the pin hole 29A of the intermediate member 2A via the engagement switch oil passage 9A as illustrated in FIG. 3A, the pin 7A moves to be inserted into the pin hole 19A of the outer rotor 1A against the biasing force of the spring 8A as illustrated in FIG. 4A. Accordingly, the function of the intermediate member 2A is changed from the vane 4 provided at the inner rotor 3A to a portion of the wall surface of the outer rotor 1A.

Figure 5A:
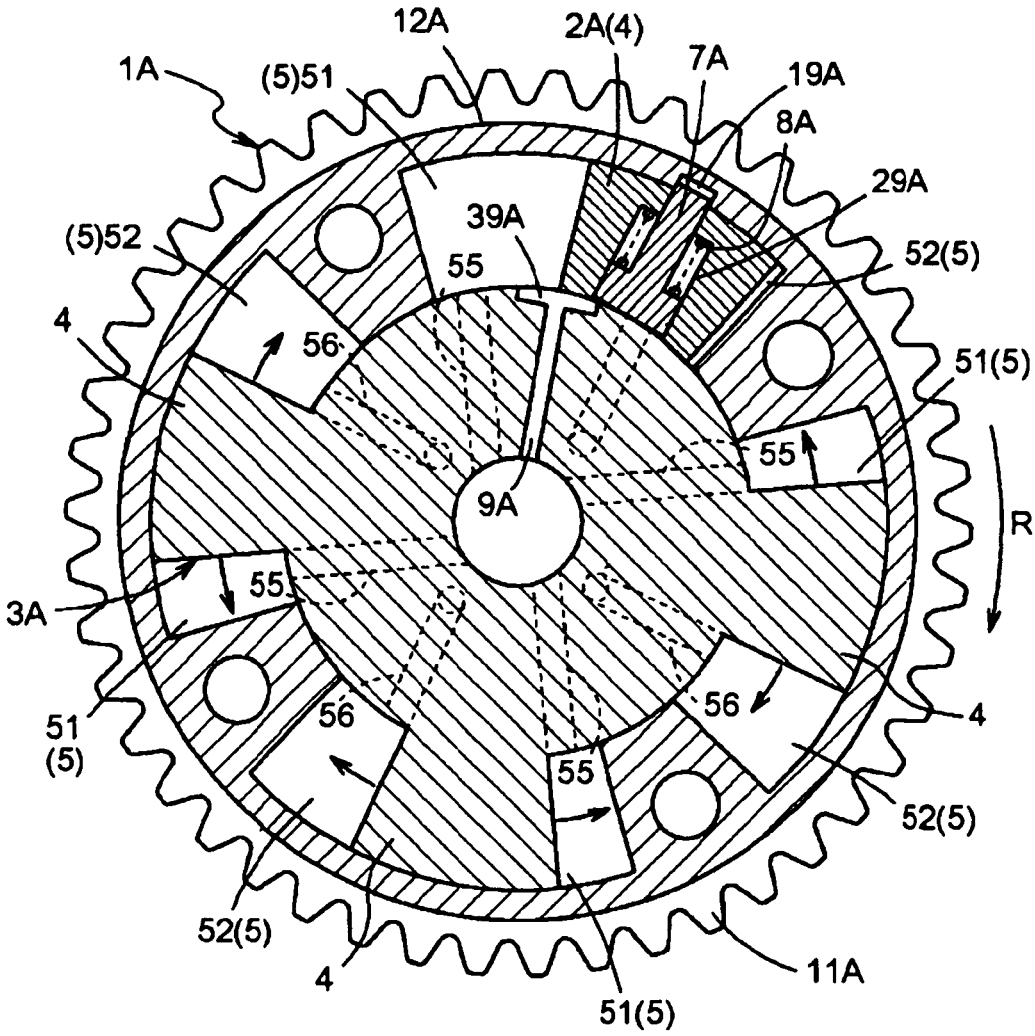
FIG. 5A is a perpendicular cross-sectional view with reference to the rotational axis of the valve timing control apparatus for illustrating a state after the engagement switch operation.
Figure 5B:
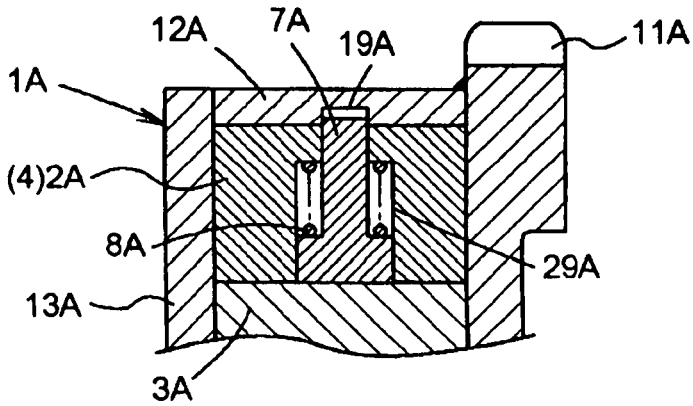
FIG. 5B is an enlarged view of the engagement portion between the engagement member and the driving side rotational member.

FIGS. 5A and 5B each illustrate a state after the engagement switch operation. When both rotors 1A and 3A relatively rotate with each other while the intermediate member 2A is engaging with the outer rotor 1A, the oil is prevented from being supplied via the engagement switch oil passage 9A to the pin hole 29A of the intermediate member 2A. However, one end of the pin 7A biased towards the inner rotor 3A by the spring 8A engages with an end surface of the inner rotor 3A. The other end of the pin 7A is still positioned within the pin hole 19A of the outer rotor 1A and thus the engagement between the intermediate member 2A and the outer rotor 1A is retained.

In the state as illustrated in FIG. 2, the relative rotational phase of the both rotors 1A and 3A is adjusted by the supply or discharge of the oil relative to four fluid pressure chambers 5. In the state as illustrated in FIG. 5A, the relative rotational phase of the both rotors 1A and 3A is adjusted by the supply or discharge of the oil relative to three fluid pressure chambers 5 while one fluid chamber 5 is secured in place. That is, the volume and the oil pressure receiving area of the fluid pressure chamber 5 are changed to thereby control the relative rotational phase of the both rotors 1A and 3A. In addition, the multiple intermediate members 2A can be provided so that the large variation range of the volume and the oil pressure receiving area of the fluid pressure chamber 5 can be achieved.

Figure 6:
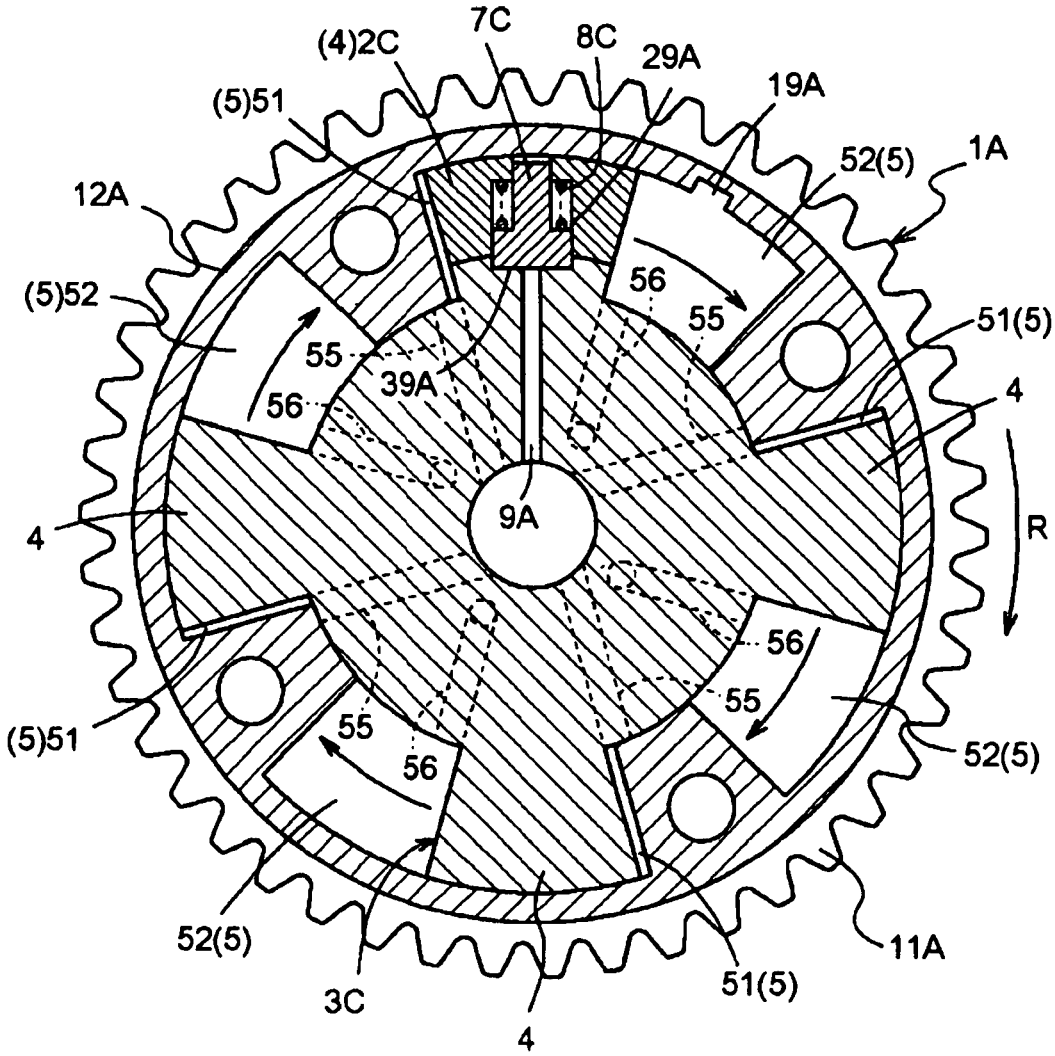
FIG. 6 is a perpendicular cross-sectional view with reference to the rotational axis of the valve timing control apparatus for illustrating an intermediate member according to an alternative embodiment of the first embodiment.

FIG. 6 is a perpendicular cross-sectional view with respect to the rotational axis of the outer rotor 1A and the inner rotor 3A for explaining an intermediate member 2C according to an alternative embodiment of the first embodiment. The intermediate member 2A illustrated in FIGS. 2 to 5 is arranged so as to be sandwiched by the outer rotor 1A and the inner rotor 3A facing each other in a radial direction thereof and functions as one of the vanes 4. In addition, the intermediate member 2A selectively engages with either the outer rotor 1A or the inner rotor 3A by means of the pin 7A that is displaceable in the radial direction of the both rotors 1A and 3A. The intermediate member 2C in FIG. 6 is also arranged so as to be sandwiched by the outer rotor 1A and the inner rotor 3A facing each other in the radial direction thereof. Then, the intermediate member 2C is biased by a spring 8C and selectively engages with either the outer rotor 1A or an inner rotor 3C by means of a pin 7C provided so as to be displaceable in the radial direction of the both rotors 1A and 3C. In this case, however, the intermediate member 2C does not function as the entire single vane 4 but functions as a part of the single vane 4 as illustrated in FIG. 6. Even with the shape of the intermediate member 2C as illustrated in FIG. 6, the volume and the oil pressure receiving area of the fluid pressure chamber 5 can be changed.

Figure 7:
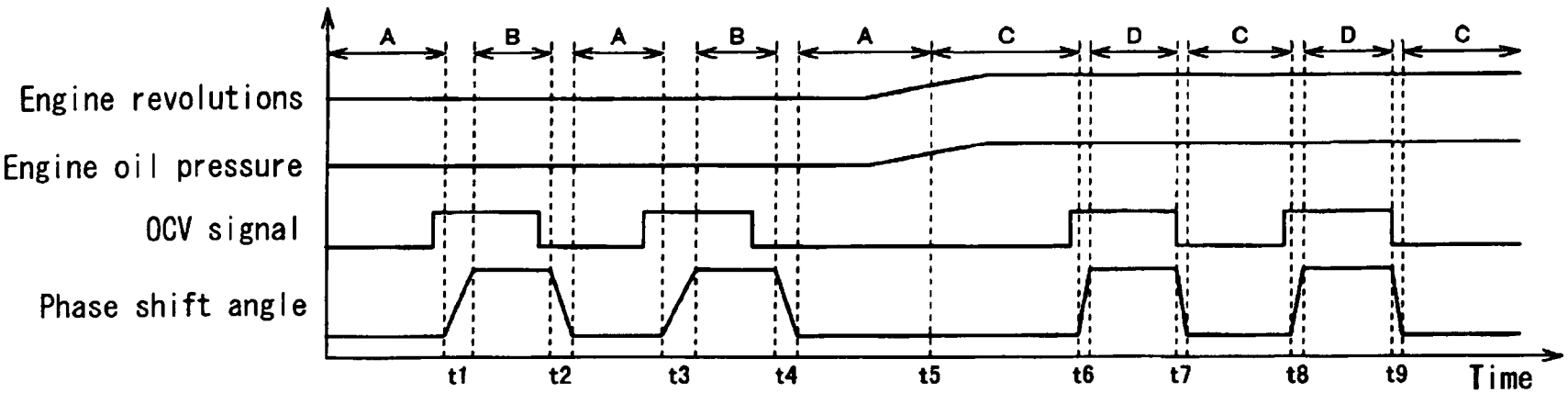
FIG. 7 is a timing chart illustrating an example of the engagement switch operation and a phase control.

FIG. 7 is a timing chart illustrating an example of the engagement switch operation and the phase control. "A" in FIG. 7 shows a state where the inner rotor 3A is positioned on the advanced angle side as illustrated in FIG. 3A and then the intermediate member 2A and the inner rotor 3A are connected to each other. "B" in FIG. 7 shows a state where the inner rotor 3A is positioned on the retarded angle side as illustrated in FIG. 2 and then the intermediate member 2A and the inner rotor 3A are connected to each other. "C" in FIG. 7 shows a state where the inner rotor 3A is positioned on the advanced angle side as illustrated in FIG. 4A and then the intermediate member 2A and the outer rotor 1A are connected to each other. "D" in FIG. 7 shows a state where the inner rotor 3A is positioned on the retarded angle side as illustrated in FIG. 5A and then the intermediate member 2A and the outer rotor 1A are connected to each other.

In the cases where the engine speed is low such as a start of the engine 6, the hydraulic pressure of the engine 6 is low. The relative rotational phase of the both rotors 1A and 3A is adjusted by an OCV signal (oil control valve signal). For example, the relative rotational phase is changed from the advanced angle side to the retarded angle side (at around time t1 and t3) because of a rising of the OCV signal. On the other hand, the relative rotational phase is changed from the retarded angle side to the advanced angle side (at around time t2 and t4) because of a dropping of the OCV signal. At this time, the intermediate member 2A and the inner rotor 3A are connected to each other and the phase shift is conducted between aforementioned A and B states.

In the cases where the engine speed increases, the hydraulic pressure of the engine 6 also increases (at around time t5). At around time t5, the oil is supplied to the pin hole 39A and then the pin hole 29A via the engagement switch oil passage 9A while the relative rotational phase is positioned on the advanced angle side. The intermediate member 2A separates from the inner rotor 3A and then engages with the outer rotor 1A (i.e., changed from A to C state) as illustrated in FIGS. 3A and 4A. Afterwards, for example, the relative rotational phase is shifted from the advanced angle side to the retarded angle side (at around time t6 and t8) because of the rising of the OCV signal, or shifted from the retarded angle side to the advanced angle side (at around t7 and t9) because of the dropping of the OCV signal. At this time, the intermediate member 2A and the outer rotor 1A engage with each other and the phase shift is conducted between aforementioned C and D states. A transition time of a phase shift angle around time t1, t2, t3, and t4 is shorter than that around time t6, t7, t8, and t9. That is, when the volume and the oil pressure receiving area of the fluid pressure chamber 5 are reduced while the hydraulic pressure of the engine 6 is in the high level, the transition time of the phase shift can be reduced and thus the responsiveness can be improved.

The intermediate member 2A that has engaged with the outer rotor 1A is brought to engage again with the inner rotor 3A at a restart of the engine 6 after stopping. After the engine stop, the hydraulic pressure of the engine 6 decreases and no oil is supplied via the engagement switch oil passage 9A. Thus, the pin 7A is displaced towards the inner rotor 3A by the biasing force of the spring 8A. At a time of the engine start, the relative rotational phase between the inner rotor 3A and the outer rotor 1A is not stable and is shifted between the retarded angle side and the advanced angle side. At this time, the pin 7A is displaced into the pin hole 39A of the inner rotor 3A to thereby bring the inner rotor 3A and the intermediate member 2A to engage with each other. In this case, of course, the relative rotational phase can be positively shifted to the most retarded angle side or the like where the engagement switch operation is possible at the engine start or stop so that the inner rotor 3A and the intermediate member 2A engage with each other.

Figure 8:
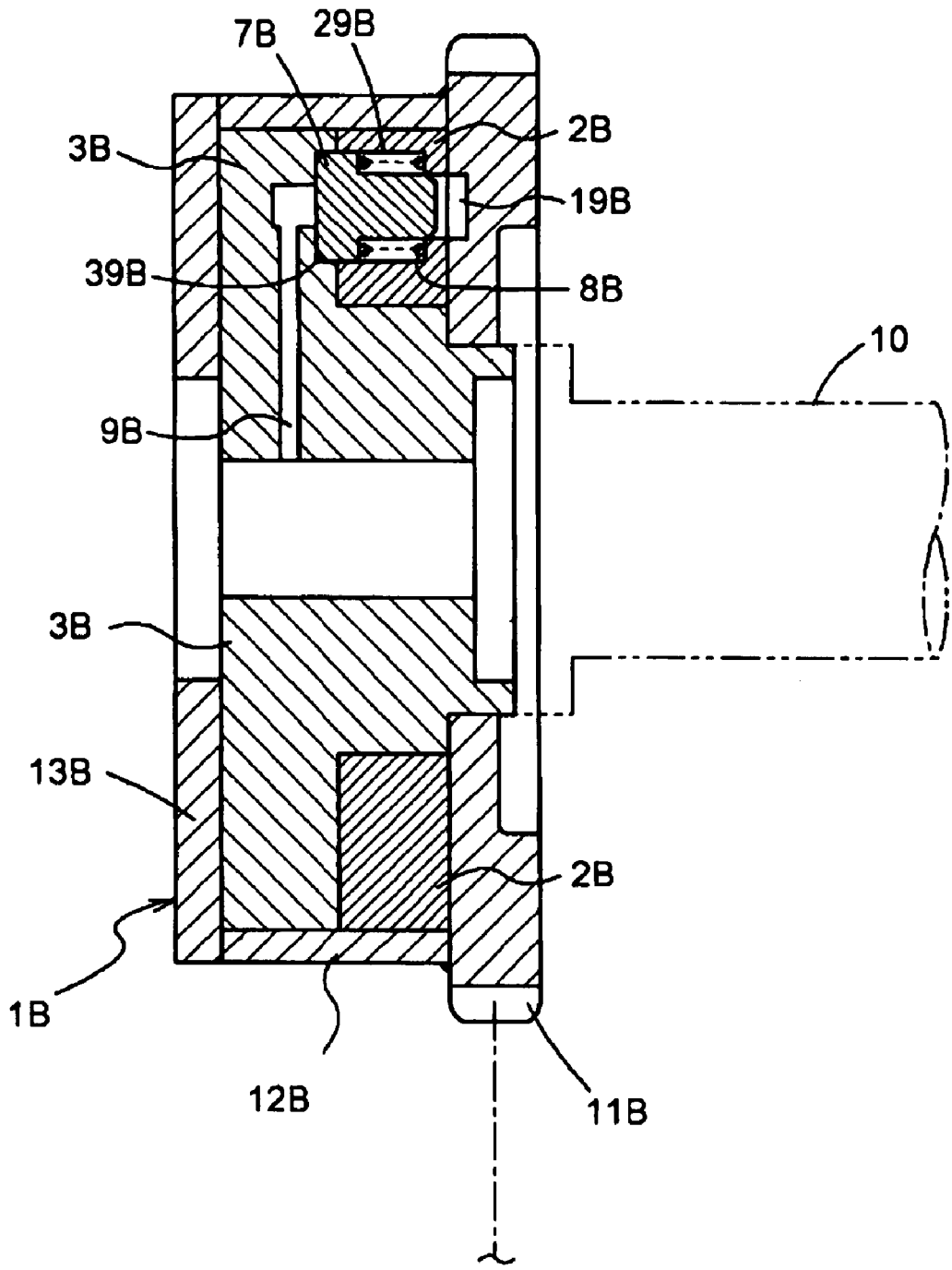
FIG. 8 is a cross-sectional view with reference to a rotational axis of a valve timing control apparatus according to a second embodiment.
Figure 9:
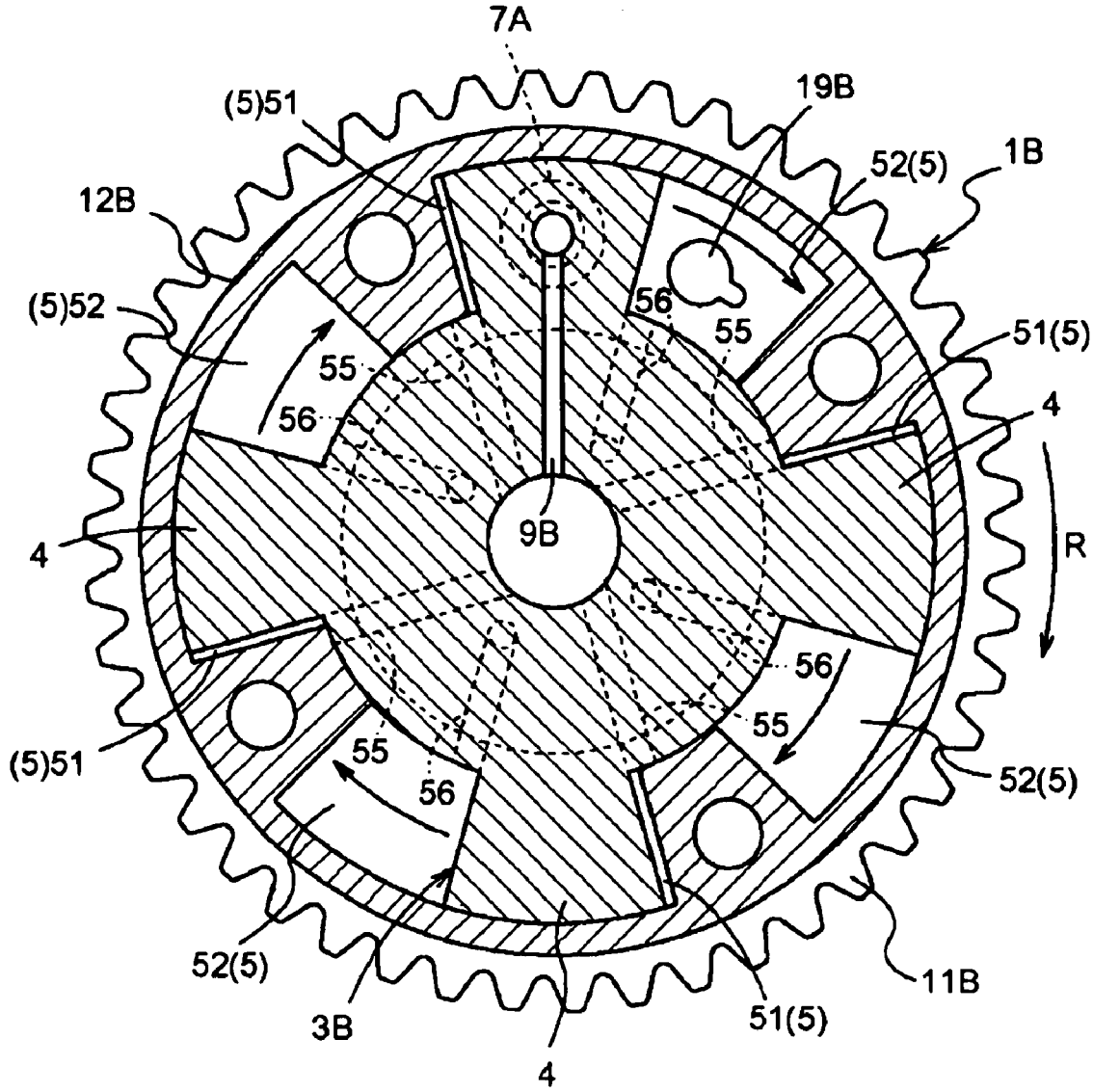
FIG. 9 is a perpendicular cross-sectional view of FIG. 8 for illustrating an initial state (i.e., state before an engagement switch operation) of a driving side rotational member, a driven side rotational member, and an intermediate member.

Next, a second embodiment will be explained with reference to FIGS. 8 to 15. FIG. 8 is a cross-sectional view of a valve timing control apparatus according to the second embodiment. FIG. 9 is a perpendicular cross-sectional view of FIG. 8. As illustrated in FIGS. 8 and 9, the vane-type valve timing control apparatus according to the second embodiment includes a driving side rotational member 1B, a driven side rotational member 3B, fluid pressure chambers 5, and vanes 4.

The driving side rotational member 1B is synchronously rotatable in an R direction in FIG. 9 with a crankshaft 15 of an engine 6. The driven side rotational member 3B is provided so as to be coaxial and relatively rotatable with the driving side rotational member 1. In addition, the driven side rotational member 3B rotates in the R direction as a unit with a camshaft 10 for opening and closing valves 14 of the engine 6. According to the present embodiment, as illustrated in FIGS. 8 and 9, the driving side rotational member 1B is an outer rotor attached to a radially outer side of an inner rotor, which is the driven side rotational member 3B. The outer rotor 1B includes a sprocket (or a pulley) 11B, a housing 12B, and a plate 13B A driving force of the engine 6 is transmitted to the sprocket 11B via a timing chain or a timing belt.

Multiple fluid pressure chambers 5 are formed between the outer rotor 1B and the inner rotor 3B. Each fluid pressure chamber 5 is divided into an advanced angle chamber 51 and a retarded angle chamber 52 by means of the vane 4. When an operational fluid such as oil is supplied to the advanced angle chamber 51, a relative rotational phase of the inner rotor 3B to the outer rotor 1B is shifted in a direction where the phase is advanced. On the other hand, when the oil is supplied to the retarded angle chamber 52, the relative rotational phase of the inner rotor 3B to the outer rotor 1B is shifted in a direction where the phase is retarded. That is, because of a supply and a discharge of the operational fluid relative to the fluid pressure chambers 5, the aforementioned relative rotational phase is adjusted. FIG. 9 illustrates a state where the relative rotational phase of the inner rotor 3B to the outer rotor 1B is positioned on a most retarded angle side. For example, when the oil is supplied to the advanced angle chambers 51 via respective advanced angle oil passages 55 from the state in FIG. 9, the inner rotor 3B rotates relative to the outer rotor 1B in an arrow direction illustrated in the fluid pressure chamber 5 in FIG. 9. That is, the inner rotor 3B is shifted in the advanced angle direction. At this time, the possible oil in the retarded angle chambers 52 is discharged therefrom via respective retarded angle oil passages 56. The vanes 4 can be provided at either the outer rotor 1B or the inner rotor 3B. According to the present embodiment, the vanes 4 are provided at the inner rotor 3B.

An intermediate member 2B illustrated in FIGS. 8 and 9 are engageable with the outer rotor 1B and the inner rotor 3B. At least a portion of the intermediate member 2B is arranged within the fluid pressure chamber 5. According to the present embodiment, one of the multiple vanes 4 for the respective fluid pressure chambers 5 is constituted by the intermediate member 2B. The intermediate member 2B engages with one of the outer rotor 1B and the inner rotor 3B via a pin 7B (engagement member) in response to the operation state of the engine 6.

Figure 10:
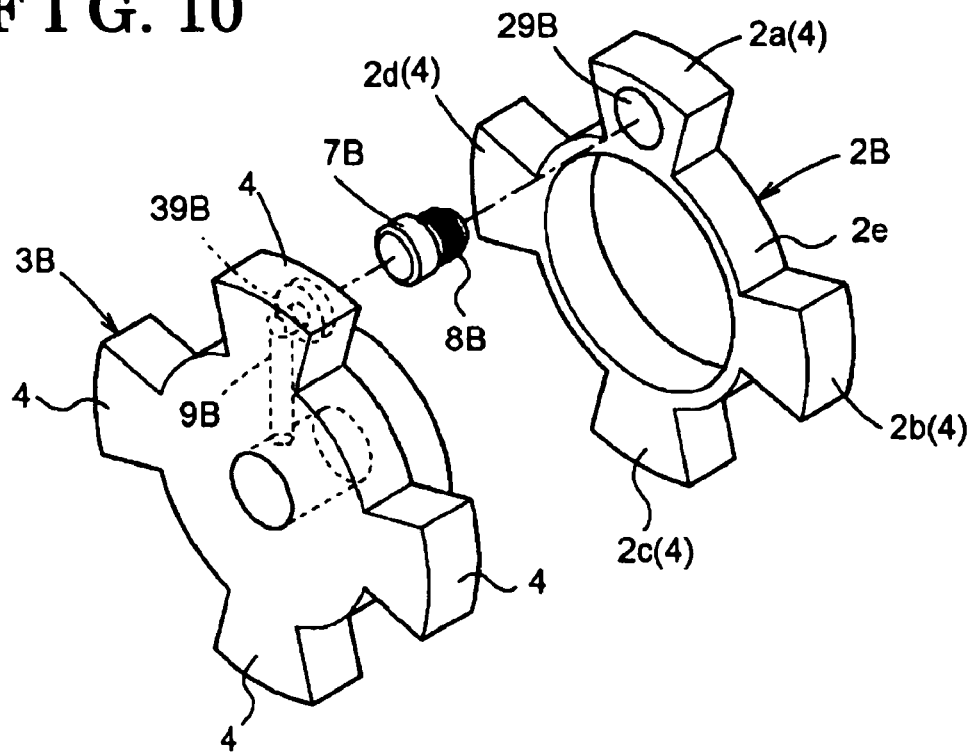
FIG. 10 is a perspective view illustrating an engagement relationship between the driven side rotational member and the intermediate member.
Figure 11A:
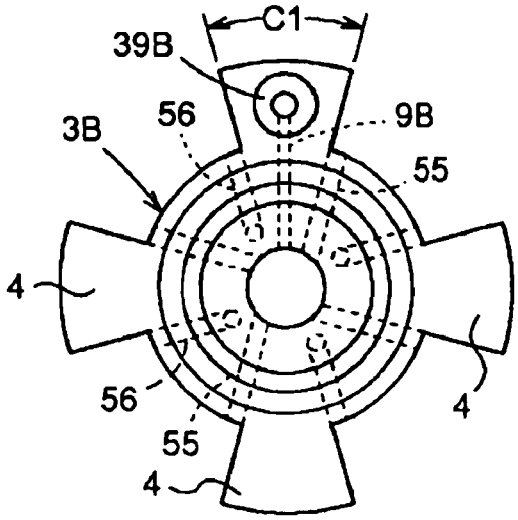
FIG. 11A is a plan view illustrating the driven side rotational member.
Figure 11B:
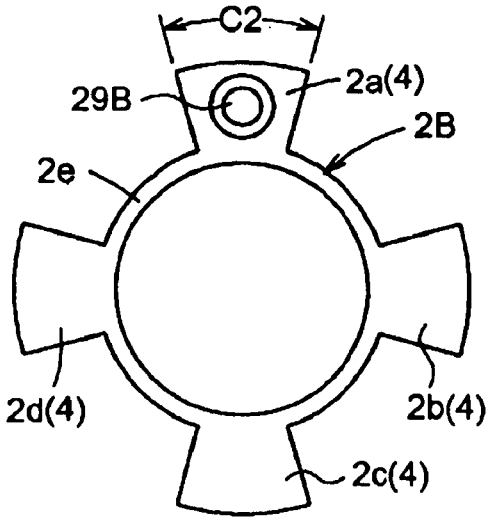
FIG. 11B is a plan view illustrating the intermediate member.

FIG. 10 is a perspective view illustrating an engagement relationship between the inner rotor 3B and the intermediate member 2B. FIGS. 11A and 11B are plan views of the inner rotor 3B and the intermediate member 2B, respectively. As illustrated in FIGS. 8 to 11, the intermediate member 2B is positioned, being sandwiched by the outer rotor 1B and the inner rotor 3B facing each other in a rotational axis direction thereof. Then, the intermediate member 2B engages with either the outer rotor 1B or the inner rotor 3B by the pin 7B that is displaceable in the rotational axis direction of the outer rotor 1B and the inner rotor 3B. The intermediate member 2B includes operation portions 2*a*, 2*b*, 2*c* and 2*d*, and a link portion 2*e*. The operation portions 2*a* to 2*d* function as the vanes together with the vanes 4 provided at the inner rotor 3B in the cases where the intermediate member 2B engages with the inner rotor 3B. The operation portions 2*a* to 2*d* arranged in the respective fluid pressure chambers 5 are connected to each other in a circumferential direction by means of the link portion 2*e*. Accordingly, positions of the operation portions 2*a* to 2*d* in multiple fluid pressure chambers 5, respectively, can be collectively changed or moved at one portion, i.e., link portion 2*e*, of the intermediate member 2B. According to the present embodiment, a pin hole 29B where the pin 7B is accommodated is formed at one of the operation portions, for example, operation portion 2*a*. As illustrated in FIGS. 11A and 11B, a circumferential length C1 of each of the vanes 4 provided at the inner rotor 3B and a circumferential length C2 of each of the operation portions 2*a* to 2*d* are equal to each other. Each vane 4 is constituted by the inner rotor 3B and the intermediate member 2B engaging with each other.

The pin 7B is biased by a spring 8B (biasing means) in a direction in which the intermediate member 2B and the inner rotor 3B serving as the rotational member where the vanes 4 are provided engage with each other. The intermediate member 2B engages with the inner rotor 3B as in an initial state (such as a state illustrated in FIG. 9). At this time, the intermediate member 2B functions as the vanes 4. Then, an engagement switching means 9B displaces a position of the pin 7B against the biasing force of the spring 8B. The engagement switching means 9B releases the engagement between the inner rotor 3B and the intermediate member 2B while bringing the outer rotor 1B, where the vanes 4 are not provided, to engage with the intermediate member 2B. At this time, the intermediate member 2B functions as a wall surface of the outer rotor 1B. That is, the volume, the oil pressure receiving area, and the like of the fluid pressure chamber 5 vary depending on whether the intermediate member 2B engages with the outer rotor 1B or the inner rotor 3B. An operation performed by the engagement switching means 9B for displacing a position of the pin 7B so that the intermediate member 2B can engage with either the outer rotor 1B or the inner rotor 3B will be hereinafter referred to as an engagement switch operation.

The engagement switching means 9B displaces the position of the pin 7B by means of the oil pressure. According to the present embodiment, an engagement switch oil passage is provided as the engagement switching means 9B apart from the advanced angle oil passages 55 or the retarded angle oil passages 56.

Figure 12A:
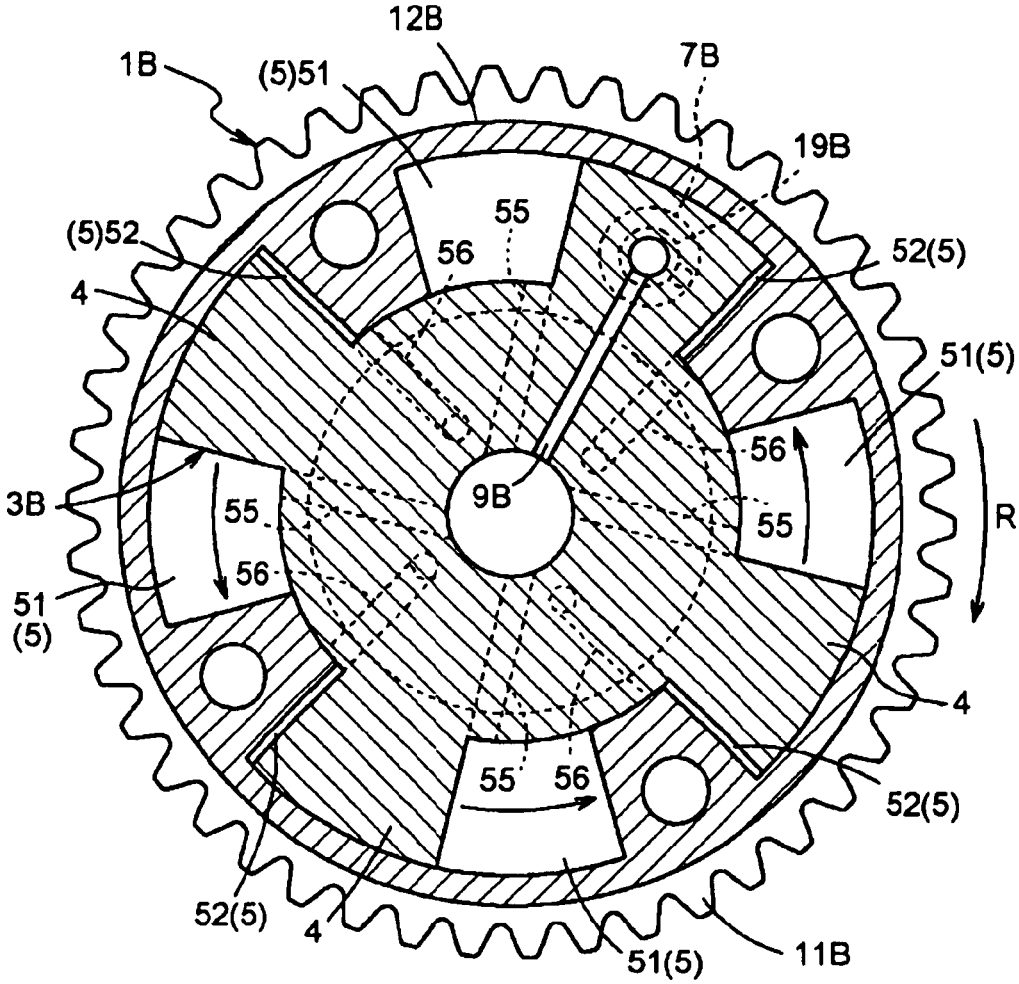
FIG. 12A is a perpendicular cross-sectional view with reference to the rotational axis of the valve timing control apparatus for illustrating a state at a time of the engagement switch operation.
Figure 12B:
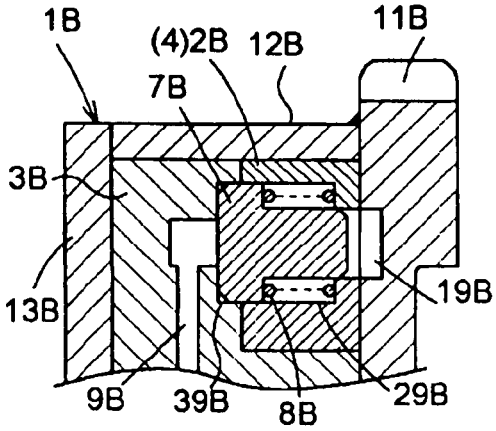
FIG. 12B illustrates a state immediately before the engagement switch operation.

An operation of the valve timing control apparatus according to the present embodiment will be explained with reference to FIGS. 12 and 13 in addition to FIGS. 8 to 11. FIGS. 12A and 13A are perpendicular cross-sectional views with respect to a rotational axis of the outer rotor 1B and the inner rotor 3B. FIGS. 12B and 13B are enlarged views of an engagement portion between the pin 7B and the inner rotor 3B or the outer rotor 1B. As explained in the above, FIG. 9 is a perpendicular cross-sectional view of FIG. 8 for explaining the initial state (i.e., state before the engagement switch operation) of the outer rotor 1B, the inner rotor 3B, and the intermediate member 2B. In FIG. 9, the relative rotational phase of the inner rotor 3B to the outer rotor 1B is positioned on the most retarded angle side and is shifted towards the advanced angle side in a manner as mentioned above.

Figure 12C:
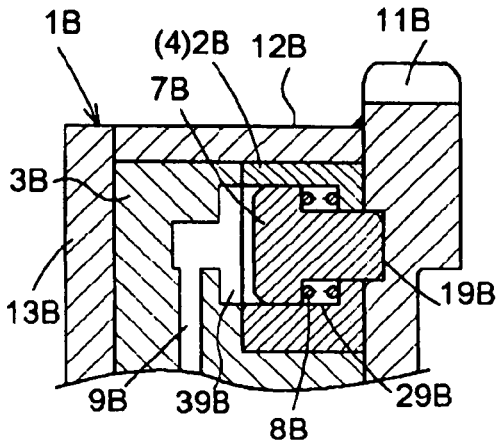
FIG. 12C illustrates a state immediately after the engagement switch operation.

FIG. 12B illustrates a state immediately before the engagement switch operation. FIG. 12C illustrates a state immediately after the engagement switch operation. In addition, FIGS. 12A to 12C illustrate the relative rotational phase positioned on the most advanced angle side. However, the engagement switch operation is not necessarily performed at the most advanced angle phase and can be performed at an intermediate phase. Further, FIG. 12A illustrates a relative rotational phase of the inner rotor 3B to the outer rotor 1B (which will be hereinafter referred to as a "relative rotational phase of the both rotors") at which the engagement switch operation can be performed. The pin 7B is biased by the spring 8B within the pin hole 29B of the intermediate member 2B so as to be inserted into a pin hole 39B of the inner rotor 3B. Thus, the intermediate member 2B and the inner rotor 3B engage with each other. At this relative rotational phase, the pin hole 29B of the intermediate member 2B and a pin hole 19B of the outer rotor 1B are in communication with each other. When the oil is supplied to the pin hole 29B of the intermediate member 2B via the engagement switch oil passage 9B as illustrated in FIG. 12B, the pin 7B moves to be inserted into the pin hole 19B of the outer rotor 1B against the biasing force of the spring 8B as illustrated in FIG. 12C. Accordingly, the function of the intermediate member 2B is changed from the vane 4 provided at the inner rotor 3B to a portion of the wall surface of the outer rotor 1B.

Figure 13A:
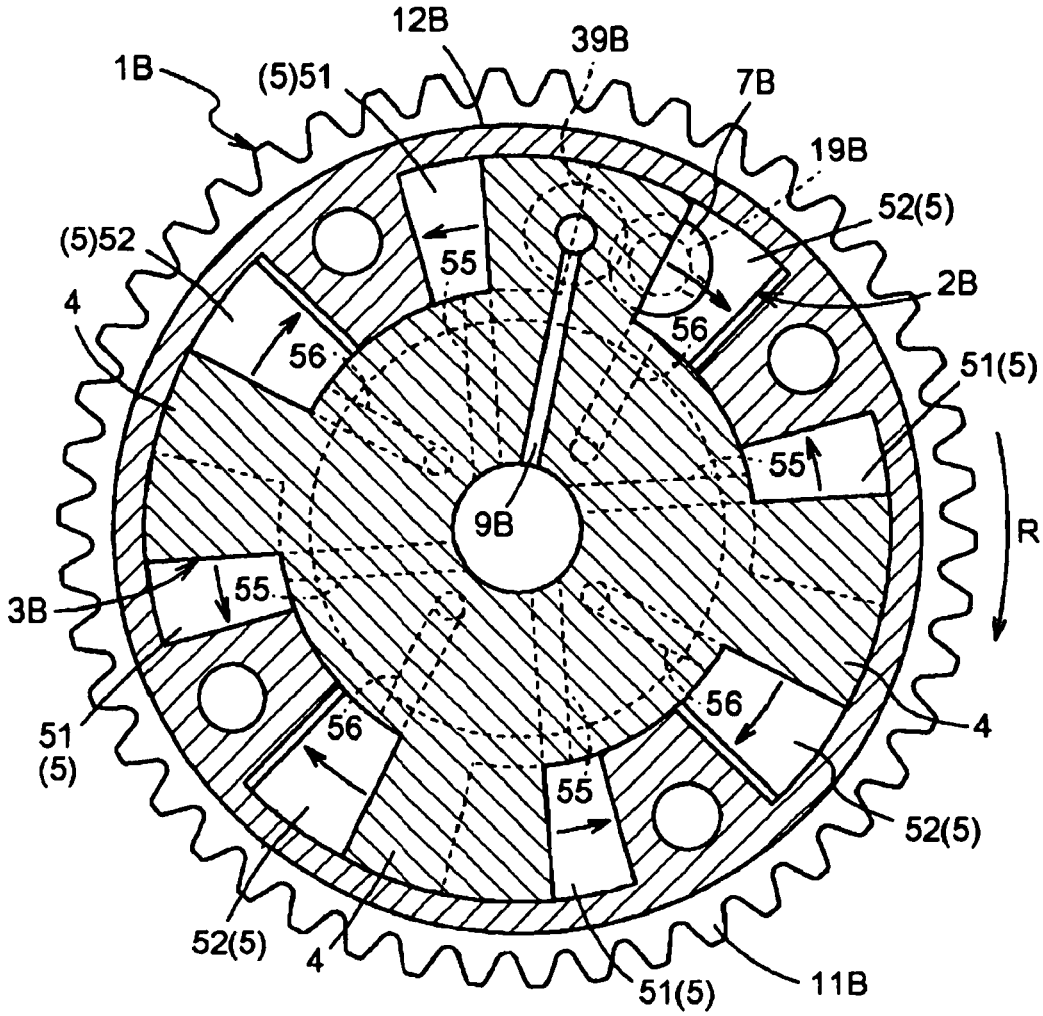
FIG. 13A is a perpendicular cross-sectional view with reference to the rotational axis of the valve timing control apparatus for illustrating a state after the engagement switch operation.
Figure 13B:
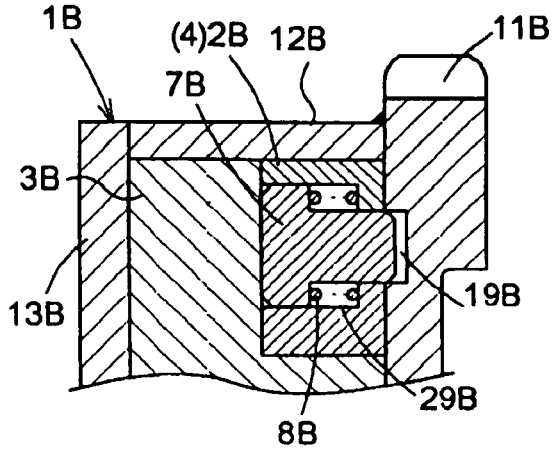
FIG. 13B illustrates a state after the engagement switch operation.

FIGS. 13A and 13B each illustrate a state after the engagement switch operation. When both rotors 1B and 3B relatively rotate with each other while the intermediate member 2B is engaging with the outer rotor 1B, the oil is prevented from being supplied via the engagement switch oil passage 9B to the pin hole 29B of the intermediate member 2B. However, one end of the pin 7B biased towards the inner rotor 3B by the spring 8B engages with an end surface of the inner rotor 3B. The other end of the pin 7B is still positioned within the pin hole 19B of the outer rotor 1B and thus the engagement between the intermediate member 2B and the outer rotor 1B is retained.

In the state as illustrated in FIG. 9, the relative rotational phase of the both rotors 1B and 3B is adjusted by means of the whole volume of the four fluid pressure chambers 5. In the state as illustrated in FIG. 13A, the relative rotational phase of the both rotors 1B and 3B is adjusted by the supply and discharge of the oil relative to a portion of the volume of the fluid pressure chambers 5. That is, the volume and the oil pressure receiving area of the fluid pressure chamber 5 are changed to thereby control the relative rotational phase of the both rotors 1B and 3B. In addition, it is not necessary for the intermediate member 2B to change the volume of all fluid pressure chambers 5 and is allowed to change only the volume of some of the fluid pressure chambers 5. In the cases where the volume of all fluid pressure chambers 5 is changed as in the present embodiment, the valve timing control apparatus with a well balanced hydraulic pressure before and after the engagement switch operation can be obtained. In this case, of course, changes of volume in respective fluid pressure chambers 5 can be positively made differed from each other.

FIG. 7 is also applicable to illustrate an example of the engagement switch operation and the phase control according to the second embodiment. "A" in FIG. 7 shows a state where the inner rotor 3B is positioned on the advanced angle side as illustrated in FIG. 12A and then the intermediate member 2B and the inner rotor 3B are connected to each other as illustrated in 12B. "B" in FIG. 7 shows a state where the inner rotor 3B is positioned on the retarded angle side as illustrated in FIG. 9 and then the intermediate member 2B and the inner rotor 3B are connected to each other as illustrated in FIG. 8. "C" in FIG. 7 shows a state where the inner rotor 3B is positioned on the advanced angle side as illustrated in FIG. 12A and then the intermediate member 2B and the outer rotor 1B are connected to each other as illustrated in FIG. 12C. "D" in FIG. 7 shows a state where the inner rotor 3B is positioned on the retarded angle side as illustrated in FIG. 13A and then the intermediate member 2B and the outer rotor 1B are connected to each other as illustrated in Fig. B.

In the cases where the engine speed is low such as at start of the engine 6, the hydraulic pressure of the engine 6 is low. The relative rotational phase of the both rotors 1B and 3B is adjusted by an OCV signal (oil control valve signal). For example, the relative rotational phase is changed from the advanced angle side to the retarded angle side (at around time t1 and t3) because of a rising of the OCV signal. On the other hand, the relative rotational phase is changed from the retarded angle side to the advanced angle side (at around time t2 and t4) because of a dropping of the OCV signal. At this time, the intermediate member 2B and the inner rotor 3B are connected to each other and the phase shift is conducted between aforementioned A and B states.

In the cases where the engine speed increases, the hydraulic pressure of the engine 6 also increases (at around time t5). At around time t5, the oil is supplied to the pin hole 39B and then the pin hole 29B via the engagement switch oil passage 9B while the relative rotational phase is positioned on the advanced angle side. The intermediate member 2B separates from the inner rotor 3B and then engages with the outer rotor 1B (i.e., changed from A to C state) as illustrated in FIG. 12C. Afterwards, for example, the relative rotational phase is shifted from the advanced angle side to the retarded angle side (at around time t6 and t8) because of the rising of the OCV signal, or shifted from the retarded angle side to the advanced angle side (at around t7 and t9) because of the dropping of the OCV signal. At this time, the intermediate member 2B and the inner rotor 3B engage with each other and the phase shift is conducted between aforementioned C and D states. A transition time of a phase shift angle around time t1, t2, t3, and t4 is shorter than that around time t6, t7, t8, and t9. That is, when the volume and the oil pressure receiving area of the fluid pressure chamber 5 are reduced while the hydraulic pressure of the engine 6 is in the high level, the transition time of the phase shift can be reduced and thus the responsiveness can be improved.

The intermediate member 2B that has engaged with the outer rotor 1B is brought to engage again with the inner rotor 3B at a restart of the engine 6 after stopping. After the engine stop, the hydraulic pressure of the engine 6 decreases and no oil is supplied via the engagement switch oil passage 9B. Thus, the pin 7B is displaced towards the inner rotor 3B by the biasing force of the spring 8B. At a time of the engine start, the relative rotational phase between the inner rotor 3B and the outer rotor 1B is not stable and is shifted between the retarded angle side and the advanced angle side. At this time, the pin 7B is displaced into the pin hole 39B of the inner rotor 3B to thereby bring the inner rotor 3B and the intermediate member 2B to engage with each other. In this case, of course, the relative rotational phase can be positively shifted to the most retarded angle side or the like where the engagement switch operation is possible at the engine start or stop so that the inner rotor 3B and the intermediate member 2B engage with each other.

Figure 14A:
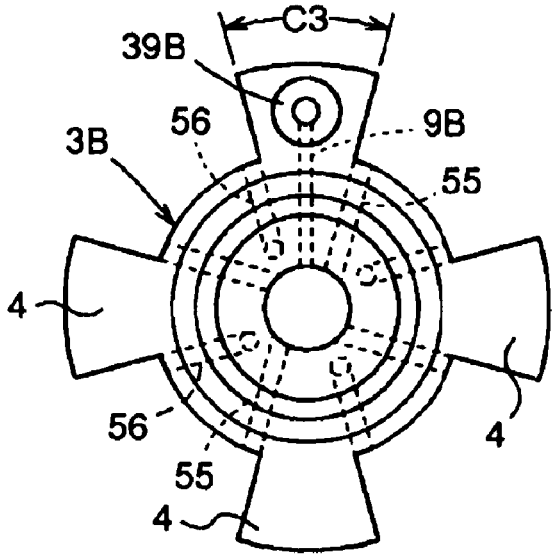
FIGS. 14A and 14B are plan views illustrating the driven side rotational member and the intermediate member, respectively, according to an alternative embodiment of the second embodiment.
Figure 14B:
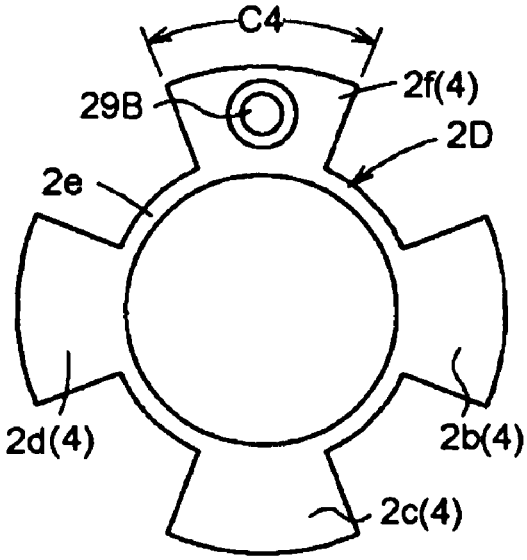

FIGS. 14A and 14B are plan views of the inner rotor 3B and the intermediate member 2B, respectively, according to an alternative embodiment of the second embodiment. According to the aforementioned second embodiment, as illustrated in FIGS. 11A and 11B, the circumferential length C1 of the vane 4 of the inner rotor 3B and the circumferential length C2 of the operation portion 2*a* are equal to each other. Then, the single vane 4 is constituted by the inner rotor 3B and the intermediate member 2B to engage with each other. According to this alternative embodiment, as illustrated in FIGS. 14A and 14B, a circumferential length C3 of the vane 4 of the inner rotor 3B is longer than a circumferential length C4 of an operation portion 2*f* that corresponds to the operation portion 2*a* in the second embodiment. That is, at least in one fluid pressure chamber 5, an intermediate member 2D that engages with either the inner rotor 3B or the outer rotor 1B by means of the pin 7B has a longer length in the circumferential direction than the circumferential length of the vane 4. As a result, a movable range of the intermediate member 2D in the state where the relative rotational phase between the inner rotor 3B and the outer rotor 1B is not stable such as at the start of the engine 6 can be made smaller so that the initial state can be easily recovered. In addition, since the vanes 4 provided at the inner rotor 3B are used at the high revolutions of the engine 6, the phase shift with the high accuracy can be achieved.

According to the aforementioned first and second embodiments, the intermediate member 2A, 2B, 2C, or 2D can engage with either one of the outer rotor 1A or 1B, or the inner rotor 3A, 3B, or 3C in response to the operation state of the engine 6. The pressure receiving area, i.e., the vane 4, is made variable depending on which rotor the intermediate member 2A, 2B, 2C, or 2D of which a portion is provided in the fluid pressure chamber 5 engages with. Alternatively, the volume of the fluid pressure chamber 5 is made variable. Accordingly, the pressure receiving area and the volume of the fluid pressure chamber 5 are adjustable in response to the revolutions of the engine 6. The valve timing control apparatus with the excellent operational responsiveness can be provided regardless of the revolutions of the engine 6. In an alternative method, the pressure receiving area of the fluid pressure chamber 5 can be reduced by blocking a supply path of the fluid to multiple fluid pressure chambers 5. However, according to such a method, a magnificent change is required for the fluid pressure circuit. On the other hand, according to the aforementioned embodiments, the volume of the fluid pressure chamber 5 is variable while the supply and discharge path of the fluid relative to the fluid pressure chamber 5 is still retained to thereby improve the operational responsiveness with a simple structure.

In addition, according to the aforementioned first and second embodiments, the variable valve control apparatus further includes the spring 8A or 8B for biasing the pin 7A, 7B, or 7C in a direction where the intermediate member 2A, 2B, 2C, or 2D engages with either one of the outer rotor 1A or 1B and the inner rotor 3A, 3B, or 3C at which the vanes 4 are provided, and engagement switching means 9A or 9B for displacing a position of the pin 7A, 7B, or 7C against a biasing force of the spring 8A or 8B so as to cancel an engagement between the intermediate member 2A, 2B, 2C, or 2D and either one of the outer rotor 1A or 1B and the inner rotor 3A, 3B, or 3C at which the vanes 4 are provided and at the same time to cause the intermediate member 2A, 2B, 2C, or 2D and either one of the outer rotor 1A or 1B and the inner rotor 3A, 3B, or 3C at which the vanes 4 are prevented from being provided.

Accordingly, the pin 7A, 7B, or 7C is biased by the spring 8A or 8B to thereby cause the intermediate member 2A, 2B, 2C, or 2D and one of the rotors where the vanes 4 are provided to engage with each other. Thus, in the initial state such as the start of the engine 6, the maximum pressure receiving area and the volume of the fluid pressure chamber 5 can be achieved. In addition, since the engagement member 7A, 7B, or 7C is displaced by the engagement switching means 9A or 9B in a direction opposite to the biasing direction, the pressure receiving area and the volume of the fluid pressure chamber 5 can be reduced when necessary to thereby improve the operational responsiveness.

Further, according to the aforementioned first embodiment, the intermediate member 2A or 2C is arranged by being sandwiched by the outer rotor 1A and the inner rotor 3A or 3C facing each other in a radial direction thereof, and the pin 7A or 7C is provided so as to be displaceable in the radial direction of the outer rotor 1A and the inner rotor 3A or 3C.

According to such a structure, the intermediate member 2A or 2C can constitute the entire single vane. Then, when the intermediate member 2A or 2C engages with one of the rotors where the vanes 4 are provided, the intermediate member 2A or 2C can be used as the vane. In the cases where the intermediate member 2A or 2C engages with the other one of the rotors where the vanes 4 are not provided, the intermediate member 2A or 2C, i.e., the vane, is fixed, i.e., the intermediate member 2A or 2C serves as a fixed wall of the fluid pressure chamber 5. Thus, at least one of the multiple fluid pressure chambers 5 is temporarily prevented from functioning as the fluid pressure chamber 5 while retaining the supply and discharge passage of the operational fluid. As a result, the pressure receiving area and the volume of the fluid pressure chamber 5 can be reduced to thereby improve the operational responsiveness.

Furthermore, according to the aforementioned first embodiment, the engagement switching means 9A displaces a position of the pin 7A or 7C by means of either one of a hydraulic pressure of the fluid and a centrifugal force generated in relation to a rotation of either one of outer rotor 1A and the inner rotor 3A or 3C.

At the start of the engine 6, the supply of the operational fluid is small and also the fluid pressure is low. Thus, in order to obtain necessary torque, the maximum pressure receiving area and the volume of the fluid pressure chamber 5 are required. On the other hand, when the revolutions of the engine 6 increase, it is desirable to reduce the pressure receiving area and the volume of the fluid pressure chamber 5 so as to achieve a prompt control. When the revolutions of the engine 6 increase, the revolutions of the outer rotor 1A and the inner rotor 3A or 3C also increase. Accordingly, the pin 7A or 7C is displaced in the radially outer direction of the both rotors by receiving the centrifugal force increasing in association with the increase of the revolutions of the rotors. Then, the pressure receiving area and the volume of the fluid pressure chamber 5 are reduced to thereby improve the operational responsiveness with a simple structure. Further, when the revolutions of the rotors increase, sufficient supply of the operational fluid and the fluid pressure can be obtained. Thus, the pin 7A or 7C can be displaced because of the pressure of the operational fluid to thereby achieve a reliable and accurate control.

Furthermore, according to the aforementioned second embodiment, the intermediate member 2B or 2D is arranged by being sandwiched by the outer rotor 1B and the inner rotor 3B facing each other in a rotational axis direction thereof, and the pin 7B is provided so as to be displaceable in the rotational axis direction of the outer rotor 1B and the inner rotor 3B.

When the intermediate member engages with one of the rotors where the vanes 4 are provided, the intermediate member 2B or 2D can be used as the vane. In the cases where the intermediate member 2B or 2D engages with the other one of the rotors where the vanes 4 are not provided, the intermediate member 2B or 2D is used as a fixed wall of the fluid pressure chamber 5. Thus, the pressure receiving area and the volume of the fluid pressure chamber 5 where the intermediate member 2B or 2D is provided can be reduced to improve the operation responsiveness.

Furthermore, according to the aforementioned second embodiment, the intermediate member 2B or 2D arranged in the fluid pressure chambers 5 is continuously formed in a circumferential direction thereof.

According to the aforementioned structure, respective portions of the intermediate member 2B or 2D are provided at multiple fluid pressure chambers 5 arranged in the circumferential direction. That is, the intermediate member 2B or 2D can be provided at all the fluid pressure chambers 5. Further, the respective portions of the intermediate member 2B or 2D constitute a single intermediate member by being connected in the circumferential direction. Thus, the function of the intermediate member 2B or 2D in respective fluid chambers 5 can be collectively switched or changed by an engagement at a single portion where the respective portions of the intermediate member 2B or 2D are connected to each other. According to such structure, whichever the fluid pressure is equal or is intentionally unbalanced among respective fluid pressure chambers 5, it may be easy to achieve an appropriate balance among fluid pressure chambers 5. As a result, the valve timing control apparatus with the excellent operational responsiveness can be achieved.

Furthermore, according to the aforementioned alternative embodiment of the second embodiment, the intermediate member 2D engaging with either one of the outer rotor 1B and the inner rotor 3B by means of the pin 7B includes a longer circumferential length C4 in one of the fluid pressure chambers 5 than a circumferential length C3 of the vane 4 provided in each of the fluid pressure chambers 5.

According to the intermediate member 2D that functions as the vane when engaging with one of the rotors where the vanes 4 are provided, a portion of the intermediate member 2D functioning as the vane is longer in length in the circumferential direction C4 than the circumferential length C3 of one of the rotors constantly functioning as the vane. The intermediate member 2D, after separating from one of the rotors and engaging with the other one of the rotors where the vanes 4 are not provided, should return to the initial state where the intermediate member 2D engages with one of the rotors where the vanes 4 are provided. Since the engagement member 2D is biased in a direction so as to engage with one of the rotors, the intermediate member 2D can return to the initial state as long as positions of one of the rotors and the intermediate member 2D match each other. In the cases where the circumferential length of the intermediate member 2D is long, a movable distance thereof in the fluid pressure chamber 5 is small and thus positioning between one of the rotors and the intermediate member 2D can be easily conducted. After the intermediate member 2D engages with the other one of the rotors, a sufficient movable distance is secured for the vanes 4 of one of the rotors that independently adjust the relative rotational phase between the both rotors. Thus, the pressure receiving area of the fluid pressure chamber 5 can be variable and the intermediate member 2D can easily return to the initial state to thereby provide the valve timing control apparatus with the excellent operational responsiveness.

Furthermore, according to the aforementioned second embodiment, the engagement switching means 9B displaces a position of the pin 7B by means of a hydraulic pressure of the fluid.

At the start of the engine 6, the supply of the operational fluid is small and also the fluid pressure is low. Thus, in order to obtain necessary torque, the maximum pressure receiving area and the volume of the fluid pressure chamber 5 are required. On the other hand, when the revolutions of the engine 6 increase, it is desirable to reduce the pressure receiving area and the volume of the fluid pressure chamber 5 so as to achieve a prompt control. When the revolutions of the rotors increase, sufficient supply of the operational fluid and the fluid pressure can be obtained. Thus, the pin 7B can be displaced by means of the pressure of the operational fluid to thereby achieve a reliable and accurate control.

The principles, preferred embodiment and mode of operation of the present invention have been described in the foregoing specification. However, the invention which is intended to be protected is not to be construed as limited to the particular embodiments disclosed. Further, the embodiments described herein are to be regarded as illustrative rather than restrictive. Variations and changes may be made by others, and equivalents employed, without departing from the spirit of the present invention. Accordingly, it is expressly intended that all such variations, changes and equivalents which fall within the spirit and scope of the present invention as defined in the claims, be embraced thereby.

The invention claimed is:

1. A valve timing control apparatus, comprising: a driving side rotational member synchronously rotatable with a crankshaft of an internal combustion engine; a driven side rotational member arranged coaxially with the driving side rotational member and synchronously rotatable with a camshaft that controls an opening and closing timing of valves of the internal combustion engine; a plurality of fluid pressure chambers formed between the driving side rotational member and the driven side rotational member and each including an advanced angle chamber and a retarded angle chamber, the advanced angle chamber displacing a relative rotational phase of the driven side rotational member to the driving side rotational member in an advanced angle direction by a supply of a fluid to the advanced angle chamber, the retarded angle chamber displacing the relative rotational phase of the driven side rotational member to the driving side rotational member in a retarded angle direction by the supply of the fluid to the retarded angle chamber; a plurality of vanes provided at either one of the driving side rotational member and the driven side rotational member and each dividing the fluid pressure chamber into the advanced angle chamber and the retarded angle chamber; an intermediate member of which a portion is provided in at least one of the plurality of the fluid pressure chambers and engageable with the driving side rotational member and the driven side rotational member, the intermediate member dividing said at least one of the plurality of fluid pressure chambers into the advanced angle chamber and the retarded angle chamber; and an engagement member for causing the intermediate member to engage with either one of the driving side rotational member and the driven side rotational member in response to an operating state of the internal combustion engine.

2. A valve timing control apparatus according to claim 1, further comprising biasing means for biasing the engagement member in a direction where the intermediate member engages with either one of the driving side rotational member and the driven side rotational member at which the vanes are provided, and engagement switching means for displacing a position of the engagement member against a biasing force of the biasing means so as to cancel an engagement between the intermediate member and either one of the driving side rotational member and the driven side rotational member at which the vanes are provided and at the same time to cause engagement between the intermediate member and either one of the driven side rotational member and the driving side rotational member at which the vanes are not provided.

3. A valve timing control apparatus according to claim 2, wherein the intermediate member is arranged by being sandwiched by the driving side rotational member and the driven side rotational member facing each other in a radial direction thereof, and the engagement member is provided so as to be displaceable in the radial direction of the driving side rotational member and the driven side rotational member.

4. A valve timing control apparatus according to claim 3, wherein the engagement switching means displaces a position of the engagement member by means of either one of a hydraulic pressure of the fluid and a centrifugal force generated in relation to a rotation of either one of the driving side rotational member and the driven side rotational member.

5. A valve timing control apparatus according to claim 2 wherein the intermediate member is arranged by being sandwiched by the driving side rotational member and the driven side rotational member facing each other in a rotational axis direction thereof, and the engagement member is provided so as to be displaceable in the rotational axis direction of the driving side rotational member and the driven side rotational member.

6. A valve timing control apparatus according to claim 5, wherein the intermediate member arranged in the fluid pressure chambers is continuously formed in a circumferential direction thereof.

7. A valve timing control apparatus according to claim 5, wherein the intermediate member engaging with either one of the driving side rotational member and the driven side rotational member by means of the engagement member includes a longer circumferential length in one of the fluid pressure chambers than a circumferential length of the vane provided in each of the fluid pressure chambers.

8. A valve timing control apparatus according to claim 5, wherein the engagement switching means displaces a position of the engagement member by means of a hydraulic pressure of the fluid.

9. A valve timing control apparatus according to claim 1, wherein the intermediate member functions as at least one of the plurality of vanes.

10. A valve timing control apparatus according to claim 9, wherein said at least one of the plurality of vanes includes the intermediate member.

11. A valve timing control apparatus according to claim 1, wherein the engagement member causes the intermediate member to selectively engage with either one of the driving side rotational member and the driven side rotational member.

12. A valve timing control apparatus according to claim 1, wherein the engagement member causes the intermediate member to selectively engage with either one of the driving side rotational member and the driven side rotational member in condition that the engagement member allows the relative rotation between the driving side rotational member and the driven side rotational member.

13. A valve timing control apparatus according to claim 1, wherein the engagement member causes the intermediate member to engage with one of the driving side rotational member and the driven side rotational member but to disengage from the other of the driving side rotational member and the driven side rotational member in a first operation state of the internal combustion engine, and the engagement member causes the intermediate member to engage with the other of the driving side rotational member and the driven side rotational member but to disengage from the one of the driving side rotational member and the driven side rotational member in a second operation state of the internal combustion engine.

14. A valve timing control apparatus according to claim 1, wherein the engagement member causes the intermediate member to engage with one of the driving side rotational member and the driven side rotational member so as to function as at least one of the plurality of vanes in a first operation state of the internal combustion engine, and the engagement member causes the intermediate member to engage with the other of the driving side rotational member and the driven side rotational member so as to function as a wall surface of the other o the driving side rotational member and the driven side rotational member in a second operation state of the internal combustion engine.

15. A valve timing control apparatus comprising: a driving side rotational member synchronously rotatable with a crankshaft of an internal combustion engine; a driven side rotational member coaxial with the driving side rotational member and synchronously rotatable with a camshaft that controls an opening and closing timing of valves of the internal combustion engine; a plurality of fluid pressure chambers formed between the driving side rotational member and the driven side rotational member and each including an advanced angle chamber and a retarded angle chamber, the advanced angle chamber displacing a relative rotational phase of the driven side rotational member to the driving side rotational member in an advanced angle direction by a supply of a fluid to the advanced angle chamber, the retarded angle chamber displacing the relative rotational phase of the driven side rotational member to the driving side rotational member in a retarded angle direction by the supply of the fluid to the retarded angle chamber, the plurality of fluid pressure chambers comprising a plurality of first fluid pressure chamber and a second fluid pressure chamber; a plurality of vanes provided at either one of the driving side rotational member and the driven side rotational member, each vane being positioned in a respective one of the first fluid pressure chambers and dividing the respective first fluid pressure chamber into the advanced angle chamber and the retarded angle chamber; an intermediate member, at least a portion of the intermediate member being positioned in the second fluid pressure chamber and dividing the second fluid pressure chamber into the advanced angle chamber on one side of the intermediate member and-the retarded angle chamber on an opposite side of the intermediate member; a retarded angle oil passage fluidly communicating with the retarded angle chamber of the second fluid pressure chamber, and an advanced angle oil passage fluidly communicating with the advanced angle chamber of the second fluid pressure chamber; and an engagement member causing the intermediate member to engage with either the driving side rotational member or the driven side rotational member in response to an operating state of the internal combustion engine.

* * * * *